US005633476A

United States Patent [19]

Cioffe

[11] Patent Number: 5,633,476

[45] Date of Patent: May 27, 1997

[54] METHOD OF MAKING A PROPELLANT AND EXPLOSIVE COMPOSITION

[76] Inventor: Anthony Cioffe, 5050 Fillmore St., Hollywood, Fla. 33021

[21] Appl. No.: 483,225

[22] Filed: Jun. 7, 1995

Related U.S. Application Data

[62] Division of Ser. No. 959,358, Oct. 13, 1992, Pat. No. 5,449,423.

[51] Int. Cl.[6] ..... C06B 21/00

[52] U.S. Cl. ..... 149/109.6

[58] Field of Search ..... 149/109.6

[56] References Cited

U.S. PATENT DOCUMENTS

| | | | |
|---|---|---|---|
| 3,031,288 | 4/1962 | Roberts | 149/82 |
| 3,092,528 | 6/1963 | Coving | 149/82 |
| 3,203,842 | 8/1965 | Godfrey | 149/19.5 |
| 3,712,223 | 1/1973 | Degn | 149/41 |
| 3,715,247 | 2/1973 | Wade | 149/82 |
| 3,756,874 | 9/1973 | Chang et al. | 149/19.4 |
| 3,837,992 | 9/1974 | Catanzarite | 149/83 |
| 3,862,866 | 1/1975 | Timmerman et al. | 149/77 |
| 3,870,578 | 3/1975 | Nichols | 149/19.92 |
| 3,903,219 | 9/1975 | Stephanoff | 264/3.3 |
| 3,910,805 | 10/1975 | Catanzarite | 149/83 |
| 3,953,259 | 4/1976 | Sayles | 149/19.5 |
| 3,964,255 | 6/1976 | Catanzarite | 149/77 |
| 4,128,443 | 12/1978 | Pawlak et al. | 149/82 |
| 4,497,676 | 2/1985 | Kurtz | 149/61 |
| 4,728,376 | 3/1988 | Kurtz | 149/61 |
| 4,759,885 | 7/1988 | Kurtz | 264/31 |
| 4,881,993 | 11/1989 | Furbringer et al. | 149/61 |
| 4,994,212 | 2/1991 | Vos et al. | 149/109.6 |
| 4,997,496 | 3/1991 | Wehrli et al. | 149/61 |
| 5,071,496 | 12/1991 | Coursen et al. | 149/21 |
| 5,154,782 | 10/1992 | Shaw et al. | 149/19.5 |

FOREIGN PATENT DOCUMENTS 9015788 12/1990 WIPO .

*Primary Examiner*—Edward A. Miller

*Attorney, Agent, or Firm*—Sherman and Shalloway

[57] ABSTRACT

A low temperature and low humidity process of making a pyrotechnic composition useful as gunpowder, a propellant or an explosive. The composition comprises an organic acid such as ascorbic or erythorbic acid, a nitrate salt oxidizer, and about 6–15% of potassium perchlorate, and has reduced residue upon use.

10 Claims, 1 Drawing Sheet

METHOD OF MAKING A PROPELLANT AND EXPLOSIVE COMPOSITION

This is a division of application Ser. No. 07/959,358 filed Oct. 13, 1992 which has now issued as U.S. Pat. No. 5,449,423.

BACKGROUND OF THE INVENTION

This invention relates to propellant and explosive compositions based on mixtures of organic acids, potassium nitrate and potassium perchlorate useful for propellant and other pyro-technic and explosive applications.

Many combustible compositions having utility as gunpowder, explosives, propellants and other pyro-technic applications have been formulated and many of these compositions utilize organic or inorganic nitrates as an oxidizer in combination with an organic acid as a fuel. For example, ammonium nitrate and alkali metal nitrates are preferred oxidizers.

U.S. Pat. 4,497,676 to Kurtz discloses an aqueous slurry of an organic acid, such as ascorbic or erythorbic acid, and an inorganic nitrate such as potassium nitrate which, when heated to evaporate the water, produces an explosive composite material. The material is safer to handle than black powder and produces less noxious fumes but provides similar explosive and propellant performance.

U.S. Pat. 4,728,376 to Kurtz discloses an improvement in the above composition which is obtained by heating the mixture during processing to a temperature which produces a chemical or physical change in the organic acid.

In Patent Application WO 90/15788 to Kurtz, it is also disclosed that other oxidizing agents such as potassium perchlorate can be utilized however, there is no example of a composition in which potassium perchlorate is present.

It has also been shown that corrosivity of combustion residue and decrease in smoke production can be obtained by replacing the commonly used organic acids, ascorbic acid and erythorbic acid with the corresponding 5,6-carbonyl derivatives, namely 5,6-carbonyl ascorbic acid or 5,6-carbonyl erythorbic acid. (U.S. Pat. 4,881,993 to Finbinger).

It would be desirable to obtain propellant and explosive compositions that are easily and safely handled and which tend to burn predictably, yet completely, producing little smoke and little residue. It would also be desirable to be able to provide propellant and explosive compositions in which the time to peak pressure as well as the peak pressure may be easily adjusted for each particular end use, and, which are easy to produce and safe to handle. These objectives have been difficult to obtain in a single product due to the powerful and often unpredictable oxidizer activity of nitrate containing oxidizing agents.

SUMMARY OF THE INVENTION

Figure 1:
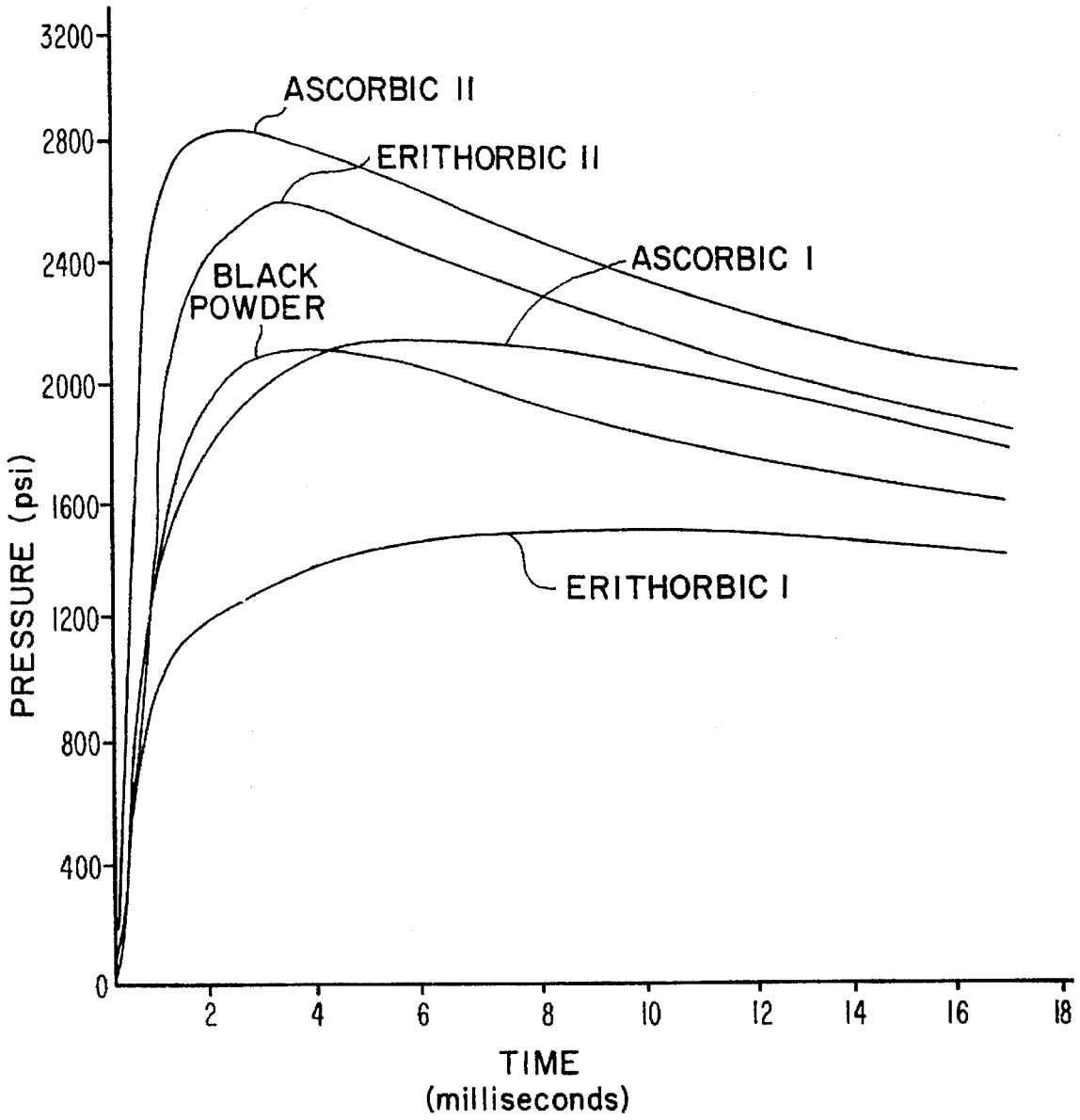
FIG. 1 is a pressure tracing of ignition materials tested with an M42Cl primer.

It has been discovered that ignitable composition comprising a homogeneous, uniform blend of an intimate admixture of at least about 0.5 to 15 weight percent potassium perchlorate, an organic or inorganic nitrate-containing oxidizing agent, and an organic acid or salt thereof, wherein said admixture comprises primary particles of from about 1 to about 50 microns provides a stable, efficient composition for use as a propellant and explosive, which produces a higher gas volume per unit weight and less residue upon combustion than most conventional formulations. Preferably, the organic acid is selected from ascorbic acid, erythorbic acid, 5,6-carbonyl ascorbic acid, 5,6-erythorbic acid, the salts thereof, or mixtures thereof. Preferably, the nitrate-containing oxidizing agent is potassium nitrate or ammonium nitrate, most preferably, potassium nitrate.

In another embodiment of the invention, the explosive and propellant composition further comprises ammonium perchlorate, and/or nitroguanidine providing a "smokeless" explosive and propellant composition.

In another embodiment of the invention, a consumable cartridge and also a cartridge comprising (1) a projectile, (2) a propellant, (3) optionally, a primer and (4) a molded cartridge case containing means for receiving said primer and means for receiving said propellant and projectile in association therewith for use in a firearm, said molded cartridge comprising a composition comprising a homogeneous, uniform blend of an intimate admixture of from about 0.5 to about 15 weight percent potassium perchlorate, and an oxidizing agent selected from organic or inorganic nitrate salts and nitroguanidine or mixtures thereof, and optionally one or more of nitrocellulose, cellulose acetate, silk, rayon, starch, nitro starch, or other synthetic or natural resin binder.

The present invention is based on the discovery that mixtures of organic acids, such as ascorbic acid or erythorbic acid, or the carbonyl or salt derivatives thereof, potassium perchlorate and, a nitrate containing oxidizing agent, such as potassium nitrate, ammonium nitrate, nitroguanidine, or mixtures thereof, when properly formulated provide a novel ignitable, e.g. propellant or explosive, composition which is useful as a dry powder or in a compressed shape of even as a gel or slurry, in various propellant, explosive and pyro-technic applications.

The composition blend of this invention provides the advantages of greater safety in its preparation and handling, less odor, smoke and residue production upon combustion and the ability to produce a large gas volume on combustion. The composition blend of this invention is an efficient replacement for a wide variety of pyrotechnic formulations, consumable cartridges, cartridge cases, liquid, gelled, and solid propellant applications, and the like. By varying the proportions of the ingredients, especially potassium perchlorate, the properties and explosive characteristics, such as ignition rates, gas volume production, peak barrel pressure, time to reach peak pressure, etc. can be easily controlled to a degree not heretofore possible with any known propellant composition. When used to shoot a projectile (e.g. bullet or rocket or pyrotechnic) from a gun, rifle, musket, tube, or other housing, the compositions of this invention leave substantially no residue and therefore, make subsequent cleaning of the housing either unnecessary or much easier than conventional propellants.

The invention in its various facets comprises ignitable composition, a method of making the composition and a consumable cartridge and other products which utilize the composition as a propellant or explosive charge.

DETAILED DESCRIPTION OF THE INVENTION

In one aspect of the invention there is provided a method of preparation of a propellant and explosive composition which is a uniform, homogeneous blend of finely fractured particles of potassium perchlorate, an organic or inorganic nitrate-containing or nitroguanidine oxidizing agent and an organic acid "fuel." According to this method the composition is formed by the steps of (1) forming an intimate admixture of finely fractured potassium perchlorate and finely fractured nitrate-containing or nitroguanidine oxidizing agent, and (2) mixing the admixture from step (1) with the organic acid "fuel" until a uniform and homogeneous emulsification is obtained. According to the invention, process steps (1) and (2) are carried out at low temperature and under "dry" conditions. As used herein low temperatures refers to temperatures below about 20° C. and more specifically, in the range of from about 4° C. to about −20° C. Also, "dry" conditions refer to relative humidity of below 40%, and more specifically, below 20%. The mixture from step (2) may, as necessary, be further processed by suitable machining, such as rolling, grinding, screening, pelletizing, and the like, to further reduce particle size and achieve still greater emulsification. Again, such further processing will be carried out under low temperatures and dry conditions.

As used herein, the "intimate admixture" of the finely divided or fractured potassium perchlorate and oxidizing agent formed in step (1) refers to the observation that these particles stick or coalesce to each other and may be considered to be fusion bonded and inseparable. Although not wishing to be bound by any theory it is believed that this phenomenon is due to the ability of the nitrate particles to absorb the small quantity of moisture in the air thus forming a somewhat sticky surface to which the perchlorate particles adhere. Subsequent compounding, such as passing the adhered particles through rollers, causes the composite particles to further coalesce or fusion bond to each other. More specifically, during compounding, e.g. blending and milling, of the mixed oxidizers, i.e. potassium perchlorate and, for example, potassium nitrate, vibration and collision between the particles fractures the crystal lattice and causes potassium perchlorate to incorporate into a mixed crystal with the potassium nitrate. Both salts crystallize in the rhombic system, so perchlorate ions are able to incorporate into gaps in the potassium nitrate crystal lattice formed by repeated fracturing of the particles, the resulting mixed crystal has different (lower) hygroscopicity than potassium nitrate. Therefore, the powder made by coating the mixed oxidizer crystals with affinity for moisture that slows combustion and accelerates air oxidation (deterioration) of the organic acid. The powder stays drier and, therefore, burns more uniformly and faster. The high temperature thermal stability and melting point of the mixed salt are altered by the presence of different (larger-perchlorate) anions in the crystal lattice. Therefore, the salt decomposes more rapidly at high temperature contributing to the increased rate of combustion of the powder.

In step (2) the organic acid is added to the mixed oxidizer from step (1) and, the vibration and milling is continued. In this process, the mixture is thoroughly blended and the intimated mixture of the oxidizer particles are coated with a film of the organic acid. By keeping the powder cool and dry during the blending and milling process air oxidation of the organic acid, is retarded and, therefore, the resulting powder retains the maximum energy content of the organic acid fuel.

Finally, compression and granulation of the blended powder increases the bulk density and, hence, the energy content per unit volume. Compression and granulation also increases the moisture resistance of the powder by decreasing porosity, and minimizing surface area available for the absorption of moisture, coating the powder grains with graphite or silicone provides additional resistance to moisture.

At this stage the composition is in the form of a free-flowing particulate or granular powdery product made up of very small (e.g. from about 1 to 50 microns, preferably 1 to 20 microns, average particle diameter) primary particles, each of which is a uniform, emulsified blend of the intimate admixture of potassium perchlorate, nitrate oxidizer, and organic acid "fuel." Although the exact chemical nature of the individual starting materials in the final product is not precisely known, however, it is believed that the organic acid "fuel" has, at this stage, been converted to a polymeric or other complex form and forms a coating or matrix for the intimate admixture of perchlorate and nitrate.

Depending on the end use application, the composition may be further processed by compaction into a final desired configuration, or by extrusion into a final desired shape, or the composition may be converted into a slurry or gel according to standard techniques known in the pyrotechnic art.

For example, the powdery product may be compacted at pressures ranging from about 4 to about 52,000 pounds per square inch (psi) or higher. For extrusion the powdery product will be slightly wetted with water or other liquid or waxy or solid lubricant to facilitate passage through the extruder. Or the powdery product may be mixed with a small quantity of an aqueous media and gelling agent(s) to form a slurry or gel.

In preparing the composition of this invention the ingredients are mixed in proportions depending upon the desired use. The relative proportions of the organic acid or salts thereof, nitrate-containing oxidizing agent and potassium perchlorate can vary widely in the composition, depending on the specific applications and particular requirements for such applications. In general, however, the percent by weight of the organic acid, or salt thereof will vary between about 30 to about 50%. The percentage by weight of potassium perchlorate will vary between about 0.5% for slow ignition, up to about 15% or even more for rapid ignition uses. The nitrate containing oxidation agent may be in the range of from about 35 to 69.5%. However, higher or lower amounts may be used for particular applications.

The proportions of organic acid, potassium perchlorate and nitrate-containing oxidizer are adjusted so that the resulting mixture is either oxygen balanced or slightly oxygen deficient for complete combustion. The rate of combustion is adjusted by changing the proportion of potassium perchlorate to potassium nitrate. For example, an oxygen deficient mixture can be obtained by mixing 12% $KClO_4$, 52% $KNO_3$ and 36% ascorbic acid and/or erythorbic acid. Such a mixture produces about 68% gaseous products by weight of the composition. At the 12% $KClO_4$ level, the amount of $KNO_3$ will preferably be maintained at 50–54% and the organic acid at 38–34%. The rate of combustion of the composition can be maintained by a 1:1 substitution of potassium nitrate for potassium perchlorate when the amount of potassium perchlorate in the composition is in the range of 0.5% to 5%. However, in order to accomplish a similar rate of combustion as a composition containing from about 6% to 15% or more potassium perchlorate, the amount of potassium nitrate is reduced by about 2–5% and the amount of organic acid is increased proportionately. Basically, the composition can be adjusted to achieve faster or slower time to peak and peak pressure depending on the desired use by increasing (faster) or decreasing (slower) the amount of potassium perchlorate.

In an especially preferred embodiment, providing high ballistic performance characteristics, the composition will contain from about 10 to 15% of potassium perchlorate, especially 12 to 13% $KClO_4$, and from about 45–60% of $KNO_3$ and from about 30 to 42% ascorbic or erythorbic acid, or the sodium salts thereof, or mixtures of the free acid(s) and salt(s).

For ballistic applications, it has been found that best results are obtained when the organic acid, nitrate-containing oxidizer and potassium perchlorate are used in amounts that are stoichiometrically balanced or approximately stiochiometically balanced, however, the composition may need to be stoichiometrically unbalanced for some purposes. The formula of the composition can be varied in relation to stoichiometric values of these components so as to increase or reduce the types and amount of gases developed upon combustion. For example, as the amount of potassium perchlorate in the composition increases and the amount of nitrate containing oxidizer decreases the speed of ignition, volume of gas produced and velocity are increased.

The nitrate containing oxidizer is preferably an alkali metal or alkaline earth metal nitrate or ammonium nitrate. Nitroguanidine may also be used for part or even all of the nitrate oxidizer. These nitrates can be used singly or in combination. Most preferably, potassium nitrate is used. However, other oxidizers, such as ammonium perchlorate, nitrate guanidine can also be utilized together with the potassium nitrate, to form the intimate admixture of potassium perchlorate and nitrate/nitroguanidine oxidizer.

The organic acid "fuel" is selected from organic acids having the general formula $C_6H_8O_6$, however, compounds having more than 6 carbon atoms but which have similar reactivity may also be used. This "fuel" may, for example, ascorbic acid (vitamin C, L-ascorbic acid, etc.), D-glucuronolactone (glucuronic acid α-lactone, glucurane, etc.), isoascorbic acid (erythorbic acid, isovitamin C, etc.), and tricarballylic acid. These organic acids "fuels" may be used in the form of their stable sodium salts such as sodium erythorbate and sodium ascorbate. The organic acid salts such as the alkali metal, e.g. sodium or potassium, alkaline earth metal, e.g. magnesium, calcium or barium, or ammonium or alkanolamine salts, may also be successfully used as the "fuel" in the compositions of this invention. Preferably, the organic acid "fuel" is ascorbic acid or erythorbic acid, the salts thereof (especially sodium salts) and mixtures thereof. For the quickest, cleanest burning "fuel" ascorbic acid is preferred. However, use of erythorbic acid is presently more economical and still yields nearly comparable performance.

It has been found that the production of smoke upon combustion is related to the amount of nitrate in the composition. In order to reduce the amount of smoke produced by the composition or to produce a "smokeless" composition, ammonium nitrate, ammonium perchlorate and/or nitroguanidine may be added to the composition. For example, in preparing a smokeless composition, liquid ammonia may be applied to potassium salts e.g., potassium nitrate, and dried. The thus treated potassium salt is ground to a fine powder and mixed with finely ground potassium perchlorate to obtain an intimate admixture. After homogeneity is obtained the organic acid and any other additives are blended in to provide a smokeless composition. The ammonium nitrate or perchlorate may completely replace the nitrate-containing oxidizer or may be used in combination therewith. The amount of smoke and solid waste produced decreases with increasing amounts of ammonium perchlorate and/or nitroguanidine used in the composition. Usually, as little as about 0.1 to 0.5% ammonium perchlorate and/or nitroguanidine may be added to the composition to provide a "smokeless" explosive or propellant. Such a composition is particularly useful in production of pyrotechnics where smoke can obscure the fireworks display. Also, reduction of smoke is also important for military applications to reduce visibility of the ignition site.

The ammonium perchlorate and/or nitroguanidine prevents water formation upon combustion, which results in reduced smoke and vapor production. Also, as the amount of ammonium perchlorate and/or nitroguanidine increases in the composition the amount of nitrogen and hydrogen gas generation significantly increases. It is believed that this volume of gas burns until all the gases are vaporized and then the powder burns, essentially giving a "two burn" combustion. This provides more fire extinguishing and propellant power and results in cleaner combustion. Compositions which generate large amounts of gas are particularly useful in mining and drilling operations and for extinguishing fires. Moreover, equipment is cleaner after combustion and consequently, the longevity of equipment is extended. In fact, it has been found that when the subject compositions are used as black powder replacement, the gun barrel requires only minimal cleaning.

If desired, further additives can be included in the composition, such as, for example, gelatinizing agents or stabilizers such as ureas, e.g. Akardit® or Centralit®, substituted urethanes, phthalates, polymers, additives for illuminating compositions such as sodium, barium, strontium or copper salts, additives for enhancing the explosive energy such as, nitroguanidine, aluminum powder, or boron powder and binders for imparting self-sustaining shape to the composition when compressed.

The composition of the present invention will initially, following the mixing and compounding of the intimate admixture of the oxidizer salts with the organic acid, be in the form of a fine dust in which individual very fine organic acid coated mixed oxidizer crystals are coalesced into larger particles in which the organic acid forms a matrix or binder for the mixed oxidizer crystals. This fine dust will generally have a particle size of up to about 100 to 200 microns, for example, in the range of 10 to 200 microns. Such fine powder is too active for use as a black powder substitute for muzzle loaders, rifles, pyrotechnics, etc., and is subject to flashing. This powder is also difficult to handle and ignition is often not controllable.

Therefore, in use for most purposes, the fine dust or powder will be compressed into a harder coherent mass which is again subjected to particle size reduction to obtain free-flowing granules of the final desired size, normally to correspond grades, F, FF, FFF or FFFF. The granules tend to be spherical in shape. In contrast, conventional black powder granules tend to flat flakes. Generally, the fine dust or powdery particles are also compressible into self-sustaining shapes such as granules, cones or rods or having various shapes such as, for example, octagonal, elongated or star shaped configurations, each such configuration providing its own unique performance characteristics. Compression of the primary particles of the free flowing powder results in larger granules comprising a plurality of compressed particles. The size of these granules can be controlled to provide granules of desired sizes for various propellant and explosive uses.

The powder can be compressed, injection molded or extruded into a variety of shapes and forms. This enables the molding of caseless (consumable) cartridges, and a variety of pyrotechnics.

The ultimate configuration and size of the particles of the blended composition determines the burn rate of the composition. The geometrical configuration and particle size has a significant effect on the sustained compression ratio of the composition.

Thus, the burn rate of a particular composition can be controlled by varying the geometrical configuration and size of the particles. Also, the speed of the powder is determined by the configuration of the particles contained therein. For example, denser packed particles deliver energy slower than looser packed particles.

Also, the powdered composition of the present burns faster when subjected to lower compression than higher compression. For example, a composition subjected to 10,000 psi burns slower and more uniformly than the identical composition subjected to 4,000 psi. The invention compositions are capable of generating high heat Of combustion, for example, at least 700 cal/gm, such as 700–1000 cal/gm. The compositions may also produce high volumes of gas on ignition, for example, at least 280 cc/g, such as 280–500 cc/g. Since the time to peak pressure will generally be much faster than for conventional black powders or black powder substitutes, when the invention compositions are used in gun barrels, for example, the peak pressure will be achieved quicker and closer to the breech such that more of the exanding gas pressure is exerted on the projectile and the projectile can achieve faster muzzle velocities and truer trajectories as determined in actual shooting range experiments.

The composition of the invention is prepared by blending an organic acid, preferably ascorbic acid, erythorbic acid, or salts thereof or mixtures thereof, with potassium perchlorate and a nitrate-containing oxidizer with any additional ingredients to be added to the formulation, under low temperature and dry conditions as described above. If too much moisture is present and/or too high temperatures are used the high performance characteristics will not be obtained. Again, although the exact reasons for the reduced performance are not completely understood, it is believed that with excess moisture or heat the nitrate oxidizer and/or perchlorate undergo a hydration reaction, as evidence by evolution of gases and vapors, thereby reducing the total available energy. Also, too much moisture causes the particles to agglomerate or otherwise interfere with formation of the intimate admixture of the perchlorate and nitrate salts.

Preferably, the components are premixed prior to blending by first separately passing each of the individual compounds through screen(s) or roller(s), or both, and thereafter, combining the previously treated compounds by blending and passing the blend through screen(s) or roller(s) or both, for example. In each case, one or more screens of successively smaller openings and one, two, or more passages through rollers with decreasing gaps between the rollers are preferably used. The order of addition of each of the ingredients has an effect on the final product. To prevent agglomeration and premature reaction or gas generation with loss of power in the final product, potassium perchlorate is finely fractured (particle size reduction) and added to the nitrate containing oxidizer, which is also finely fractured. The two components are homogeneously and uniformly compounded under conditions which impart sufficient contact, e.g., blending in a ball mill, passage through rollers, etc. thereby forming an intimate mixture. Thereafter, the organic acid and any additional additives, such as binder, are added to the intimate mixture.

Adding the organic acid after the potassium perchlorate and potassium nitrate have been compounded to an intimate admixture provides a superior explosive and propellant composition. The nitrate oxidizer/perchlorate particles are smaller and more numerous than the organic acid particles so that the organic acid encompasses or coats the particles of the intimate admixture to achieve a uniform and homogeneous blend providing a stronger, more even burn of the composition upon combustion.

The dry raw materials are each ground separately to a fine powder having the consistency of dust prior to mixing. The individual ingredients of the composition should preferably each be fractured and maintained at the same low temperature. After fracturing the individual raw materials are compounded together to form an intimate admixture which is subsequently compounded with the organic acid fuel.

Blending and premixing may be accomplished in any vibrator or dry mixing devices. Blending is carried out until the components are homogeneously mixed. After homogeneity is achieved the blended product may be passed through rollers again. Flaking may occur and the flaked material is passed through a large size screen to select granules of a desired size.

Pre-mixing and blending should be carried out in a climate controlled atmosphere having controlled temperature and humidity. Preferably the composition is blended in a dry atmosphere having about 20% humidity or less. Refrigeration or freezing temperatures are most preferred. Preferably, the temperature is maintained at from about 4° C. to about −20° C. Caution should be taken to avoid coagulation of the ingredients during blending.

While the individual ingredients may be fractured, compounded, mixed and blended essentially, manually, it is preferred that the blending, fracturing and compounding, mixing, etc. be carried out in commercially available machinery which may carry out the steps continuously and automatically. One such suitable apparatus is the Roller, Compactor, Model Nos. TF156, TF208, TF3017, and TF4015 available from Vector Corp., Marion, Iowa, and manufactured by Freund Industries Co., Ltd., Tokyo, Japan. These machines can provide compaction forces of from 15 to 40 tons, and can handle from 30 kg/hr up to 400 kg/hr.

After blending is complete the mixture may be cured, however, curing is not necessary. If curing is desired, the mixture may be spread out to collect moisture. Preferably, the mixture is exposed to 65 to 75% humidity. When the mixture changes color, such as from white to off-white or yellow, it can be processed further. It has been found that a change in color of the mixture increases performance of the finished product.

The amount of time required for curing depends on the atmospheric conditions used, however, change in color of the mixture indicates that curing is complete. Caution should be taken to prevent too much moisture from forming.

After curing the mixture is dried under controlled atmospheric conditions. The length of time required to dry the mixture depends upon the conditions used for drying. The mixture may be freeze dried, however, chemical drying of the product is preferred. Drying helps to retain the energy levels of the mixture and also effects the amount of smoke produced upon combustion of the final product. The amount of time required to dry the mixture will depend upon the conditions used and can readily be ascertained by the skilled artisan by visual inspection of the mixture.

When the mixture is completely dry it can be compressed or if the mixture has not been cured it can be compressed immediately following blending. The mixture may be subjected to compression up to about 52,000 psi. For example, to form coarse granules 4,000 to 10,000 psi is applied and it is recommended that 4,000 to 10,000 psi be applied to mixtures meant for use in muzzle-loading weapons.

The compressed mixture may be formed into blocks, sheets, tablets, pills or granules, for example. Water repellant materials may be added to prolong stability for storage. For example, 0.1% to 0.5% by weight of silicone or graphite may be added to coat the mixture. Chlorine additives can also be added. This expedient can be useful to distinguish different energy level formulations one from the other. For instance, the subject uncolored compositions are usually white to light gray. The uncolored compositions can be used to represent lower power formulations, such as those containing 0.5 to 5% $KClO_4$. A high power performance product, e.g. 12% $KClO_4$, may be colored blue by suitable dye, pigment, or other coloring agent. Still higher performance formulations, e.g. 13%, 14% and 15% $KClO_4$, may be colored orange, yellow and red, respectively, for example. Of course, different colors, or other color selections may be chosen.

The compressed product can be granulated into any grade of desired compositions. The compacted product is broken into particles and fractionated to obtain the desired sizes, generally corresponding to grades FF, FFF or FFFF.

As previously noted, the ignitable composition of the invention is useful for a variety of propellant and explosive, explosive pyrotechnic applications. For example, the product can be utilized for the manufacture of artillery shells or rifle cartridges, as a replacement for black powder, for illuminating or signal purposes, munitions for rocket propellants, blasting devices and fireworks. The compositions may also be used for the production of gas for such uses as pressurizing oil wells or extinguishing fires, for example.

Where extremely rapid initiation rates are needed, such as for propellant for pilot ejection seats, formulations containing about 15% of potassium perchlorate are desirable.

The composition can, for example, be employed as the powder charges in an antique firearm or as the explosive propellant in a consumable firearm cartridge which comprises a priming means, a projective means, propellant. Optionally, a priming means, a molded cartridge case for containing the explosive composition, may be used.

The following examples illustrate preferred embodiments of the invention composition and methods and are not intended to be limiting.

EXAMPLE 1

This Example illustrates the preparation and use of a compactible propellant-explosive composition in accordance with this invention.

255 grams of potassium nitrate are fractured for approximately 2.5 hours in a vibratory mixer using 130 grams of lead balls (50 caliber) at −20° C. in a frost-free freezer having a humidity controlled atmosphere, about 10%. 65 grams of potassium perchlorate are similarly fractured and added to the potassium nitrate. The mixture is blended mechanically to form an intimate admixture of potassium perchlorate and potassium nitrate. The mixture is further blended (after removal of the lead balls) by passing through rollers. After approximately 30 minutes the mixture achieves a uniformly grey color.

At this point, 180 grams of ascorbic acid are added to the mixture. The particles of ascorbic acid appear as white specks when first mixed with the potassium salts. Mixing is continued in a kitchen blender until the mixture turns a single light grey color indicating that a uniform blend is achieved. This process requires about 30 minutes of mixing.

The uniform mixture is then run through a series of rollers for several passes to further mix the components. The mixture is then blended at low humidity in a vibratory mixer with 130 grams of frozen lead balls. After about 12 hours the lead balls are removed by passing the mixture through a mesh screen. The mixture is again passed through a series of rollers. During the rolling process, the mixture tends to form flakes. The final homogenous mixture is light grey and consists of extremely fine particles of about 5 to 10 microns in diameter.

The particles are cured at room temperature and then are compressed to 6,000 to 10,000 psi. The compressed particles are coated with 0.2% silicone to render them resistant to atmosphere moisture and oxygen. Graphite can also be used. After coating with silicone the particles are screened with a fine mesh screen to remove any dust particles.

The final product exhibits ballistic properties upon testing with 60-grain, 80-grain, 100-grain and 120-grain loads in a 45 caliber muzzle loader with a barrel length of 28 to 32 inches, shooting a 130 grain patched lead ball. Similar results are obtained with the 120 gram load shooting a 255 gram lead maxiball projectile with velocities of about 1,500 feet per second to 2,200 feet per second being obtained. Similar results are obtained when erythorbic acid is used in place of ascorbic acid.

EXAMPLE 2

Explosive and propellant compositions are obtained by the method of Example 1 except that 10% to 50% of the potassium nitrate is replaced with ammonium nitrate, ammonium perchlorate, or nitroguanidine to produce a "smokeless powder."

The composition is processed as in Example 1 with the ammonium nitrate or ammonium perchlorate or nitroguanidine being pulverized separately and added to the premix of potassium perchlorate and reduced amount of potassium nitrate.

The final product exhibits good ballistic properties at 60-, 80-, 100- and 120-grain loads and produces significantly less smoke and solid waste than the composition of Example 1.

EXAMPLE 3

This example illustrates the preparation and use of a highly propellant and explosive composition useful for pilot ejection seats or in mining and drilling operations, or for extinguishing wells and forest fires.

The composition is obtained by the method of Example 1 except that the final composition contains 15% by weight potassium perchlorate, 45% by weight ascorbic acid or erythorbic acid and 40% by weight potassium nitrate.

The final product exhibits excellent velocity, ignition rate, gas volume production and peak barrel pressure production.

EXAMPLE 4

An explosive and propellant composition is obtained by the method of Example 1 except that the final product contains 6% by weight potassium perchlorate, 45% by weight ascorbic acid and 49% by weight potassium nitrate.

The final product exhibits reduced power in comparison to the composition of Example 3 in terms of ignition rate, velocity, gas volume, production and peak barrel pressure.

EXAMPLE 5

Explosive and propellant compositions were obtained by the method of Example 1. The formulations contain either ascorbic acid or erythorbic acid. Furthermore, each group contains one composition that is coated, after compressing with 0.2% graphite to render it resistant to atmospheric moisture. Each of the compositions exhibits a particle size distribution comparable to that of black powder.

Each composition was tested for ignitability performance through the use of an M42C1 percussion primer. The results of ignitability performance testing are shown in Table I. FIG. 1 shows typical pressure traces from the compositions erythorbic I (comparison) (no potassium perchlorate); erythorbic II (12wt % potassium perchlorate); ascorbic I (comparison) (no potassium perchlorate); and ascorbic II (13wt % potassium perchlorate); against the black powder baseline (control).

Both the ascorbic II and erythorbic II compositions (13wt % and 12wt % potassium perchlorate) are more easily ignited and produce significantly more power than black powder or the corresponding compositions lacking potassium perchlorate. The addition of the atmosphericly resistant coatings increased ignitability performance.

TABLE I

| Ignition Material | M42C1 Primer 200 mg of Ignition Material: Primer Action Time ms | Time to Peak ms | Peak Pressure psi | Pressure at 1 ms psi | Ignitability Factor % |
|---|---|---|---|---|---|
| | Average / Standard Deviation | | | | |
| Black Powder (FFG) | .399 / .038 | 3.42 / .31 | 2150 / 56 | 1413 / 103 | 67.8 / 4.9 |
| Ascorbic I (no potassium perchlorate) | .389 / .036 | 5.55 / .91 | 2198 / 70 | 1600 / 111 | 72.8 / 3.9 |
| Ascorbic II 13 wt % potassium perchlorate | .340 / .030 | 2.64 / .32 | 2870 / 154 | 2416 / 215 | 84.1 / 3.3 |
| Ascorbic II 13% potassium perchlorate 0.2% graphite | .304 / .006 | 2.47 / .27 | 2934 / 59 | 2536 / 210 | 86.4 / 6.3 |
| Ascorbic II 12% potassium perchlorate 0.2% graphite | .340 / .040 | 3.03 / .18 | 2740 / 49 | 1988 / 80 | 72.6 / 3.1 |
| Erythrobic I no potassium perchlorate | .460 / .042 | 9.29 / 1.01 | 1549 / 54 | 1035 / 94 | 66.8 / 5.5 |
| Erythorbic II 12 wt % potassium perchlorate | .310 / .050 | 3.41 / .24 | 2658 / 44 | 1908 / 98 | 71.8 / 3.3 |
| Erythrobic II 12 wt % potassium perchlorate 0.7% graphite | .330 / .020 | 3.05 / .25 | 2674 / 50 | 2044 / 89 | 76.4 / 2.2 |
| Erithorbic II 13 wt % potassium perchlorate 0.2 wt % graphite | .330 / .040 | 3.36 / .65 | 2624 / 72 | 1960 / 235 | 74.6 / 7.7 |

EXAMPLE 6

Explosive and propellant compositions were obtained by the method of Example 1 and tested for velocity, ignition rate, gas volume production, and peak barrel pressure. The following compositions were tested at up to 150-grain loads.

| Sample | % $KNO_3$ | % $KClO_4$ | Erothorbic & % Ascorbic Acid |
|---|---|---|---|
| P 13 | 51 | 13 | 36 |
| P 14-1 | 50 | 14 | 36 |
| P 14-2 | 51 | 14 | 35 |
| P 14-3 | 52 | 14 | 34 |
| P 15-1 | 49 | 15 | 36 |
| P 15-2 | 50 | 15 | 35 |
| P 5 | — | 66.3 | 33.7 |

Each of the compositions exhibited good ballistic properties at 60 grain loads, up to 150 grain loads. Velocity, ignition rate, gas volume production and peak barrel pressure increase with increasing amounts of $KClO_4$ in the formulation.

The method of manufacture described has been found to satisfactorily produce the specific results sought with these ranges of oxidizer, organic acid and potassium perchlorate. Different requirements including higher or lower chamber pressures and different ballistic characteristics can be obtained by varying the composition, the additives, the form of the compressed product, compression, particle size and curing time, for example, by utilizing known techniques used in the ammunition industry.

What is claimed is:

1. A process for the preparation of a propellant and explosive composition which process comprises (1) forming an intimate admixture of finely fractured nitrate-containing oxidizing agent and finely fractured potassium perchlorate, and (2) blending the intimate admixture from step (1) with an organic acid or salt thereof until a uniform and homogeneous mixture is obtained, wherein steps (1) and (2) are carried out at a temperature of between 20° C. to −20° C. and at a relative humidity of less than 40%.

2. The process according to claim 1 wherein the mixture is compacted at pressures ranging from about 4 to about 50,000 psi.

3. The process according to claim 1 wherein the relative humidity is less than 20%.

4. The process according to claim 1 wherein the organic acid is ascorbic acid or erythorbic acid.

5. The process according to claim 1 wherein the nitrate-containing oxidizer comprises potassium nitrate.

6. The process according to claim 1 wherein the nitrate-containing oxidizer comprises from about 45 to 55% by weight, potassium perchlorate comprises from about 6 to 15% by weight and the organic acid comprises from about 30 to 49% by weight of the total composition.

7. A process for preparing a propellant and explosive mixture comprising a uniform homogeneous blend of finely fractured particles of (A) potassium perchlorate, (B) an organic or inorganic nitrate-containing or nitroguanidine oxidizing agent and (C) an organic acid fuel, said process comprising (1) finely fracturing particles of oxidizing agent (B) at a temperature of between −20° C. and 20° C. and at a relative humidity of less than 40%;

(2) finely fracturing particles of potassium perchlorate (A) at a temperature of between −20° C. and 20° C. and at a relative humidity of less than 40%;

(3) blending the finely fractured particles from steps (1) and (2) at a temperature of between −20° C. and 20° C. and at a relative humidity of less than 40% and with sufficient contact between the particles to form an intimate and homogeneous mixture thereof;

(4) uniformly blending the organic acid fuel (C) with the intimate and homogeneous mixture from step (3) at a temperature of between −20° C. and 20° C. and at a relative humidity of less than 40%, to form a uniform and homogeneous blend;

(5) curing the uniform and homogeneous blend from step (4) by exposing the blend to an atmosphere having a relative humidity of 65 to 75% until a color change is observed;

(6) drying the cured composition from step (5).

8. The process of claim 7 wherein steps (1), (2), (3) and (4) are each carried out at a temperature of from −20° C. to 4° C. and at a relative humidity of below about 20%.

9. The process of claim 8 which further comprises compressing the dried cured composition at a pressure of from about 4,000 to about 10,000 psi.

10. The process of claim 8 which further comprises granulating the compressed composition into free-flowing granules of particle size corresponding to grades F, FF, FFF or FFFF.

* * * * *